US007299794B2

(12) United States Patent
Sexton

(10) Patent No.: US 7,299,794 B2
(45) Date of Patent: Nov. 27, 2007

(54) CONTROL SYSTEM FOR SUPPLYING FUEL VAPOUR AT START-UP AND METHOD FOR USING THE SYSTEM

(75) Inventor: Brian Sexton, Ytterby (SE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/457,482

(22) Filed: Jul. 14, 2006

(65) Prior Publication Data

US 2007/0012302 A1 Jan. 18, 2007

(30) Foreign Application Priority Data

Jul. 14, 2005 (EP) ..... 05106438

(51) Int. Cl.
*F02D 41/14* (2006.01)
*F02M 25/08* (2006.01)

(52) U.S. Cl. ..... 123/698; 123/520

(58) Field of Classification Search ..... 123/698, 123/516, 520, 525, 518
See application file for complete search history.

(56) References Cited

U.S. PATENT DOCUMENTS 5,596,972 A * 1/1997 Sultan et al. ..... 123/520
6,003,498 A * 12/1999 Reddy ..... 123/520
6,234,153 B1 5/2001 DeGroot et al.

* cited by examiner

*Primary Examiner*—Hieu T. Vo
(74) *Attorney, Agent, or Firm*—Julia Voutyras; Allan J. Lippa

(57) ABSTRACT

A method and a system for improved control of fuel supply to an internal combustion engine are presented. The system, in addition to a liquid fuel injector, includes a fuel vapor injector disposed in an engine air intake manifold. The method includes determining the state of fuel in the liquid fuel line, and adjusting the amount purge fuel vapors injected into engine air intake manifold accordingly. Thus, improved engine performance is achieved.

23 Claims, 2 Drawing Sheets

CONTROL SYSTEM FOR SUPPLYING FUEL VAPOUR AT START-UP AND METHOD FOR USING THE SYSTEM

FIELD OF INVENTION

The present invention generally relates to fuel control systems for fuel-injected vehicles and, more particularly, to a fuel injector system using fuel vapours from a canister connected to the fuel tank to power an internal combustion engine during start-up.

BACKGROUND OF THE INVENTION

Modern automotive vehicle engines commonly employ vaporized injected fuel for combustion. At start-up, when the engine is not fully warm, the injected fuel is commonly cold. Cold fuel is harder to vaporize than warm fuel. Consequently, some of the fuel may remain in a liquid state when injected. The injected liquid fuel tends to lead to decreased combustibility at start-up. This may result in undesirable emission levels.

To improve emission levels, different techniques have been employed before and after combustion. One pre-combustion treatment has been to heat the fuel prior to its injection. By heating the fuel, it becomes more easily vaporized thereby improving its combustibility. While successful, such pre-combustion heating is complex and expensive to implement. A common post-combustion treatment involves the employment of a catalyst in the engine exhaust gas stream. The catalyst burns the undesirable exhaust gas constituents prior to their passage to the atmosphere.

Modern automotive vehicles are also commonly equipped with a fuel vapour purge control system. Such a system accommodates fuel within the fuel tank which tends to evaporate as temperatures increase. The evaporated fuel collects in the fuel tank and is periodically removed by the purge vapour control system. The fuel vapours from the tank are initially collected and stored in a vapour canister. When the engine operating conditions are suitable for purging, a purge valve is opened permitting the engine to draw the fuel vapours from the purge canister into the engine for combustion.

A known system is disclosed in U.S. Pat. No. 6,234,153, describing a purge assisted fuel injection system and a method of using the same. The system includes a fuel tank coupled to a purge vapour collection canister by a vapour line. The purge vapour collection canister is coupled to a fuel injector operatively associated with an internal combustion engine by a second vapour line. A purge vapour canister vent valve selectively seals the purge vapour canister from atmosphere such that the fuel tank, purge vapour canister, and fuel injectors may form a closed system.

A vehicle provided with such a control system allows purge fuel vapour from the canister and liquid fuel to be selectively supplied to the engine via combined fuel and vapour injectors at start-up. However, such a system does not take into account that, during start-up, fuel vapour may be present in the liquid fuel supply line, commonly termed fuel rail, supplying the fuel injectors. One problem is that the fuel injectors are designed and controlled to deliver fuel in the liquid state. Hence they cannot be accurately controlled to deliver fuel in the vapour state, in order to achieve a desired Air/Fuel ratio in the engine combustion chambers.

At engine start the fuel injectors are controlled to open and deliver an appropriate amount of fuel to start and run the engine. The amount of fuel delivered is programmed in an engine management system computer as a function of coolant (water or oil) temperature, air temperature and other parameters. Prior to delivery the fuel is contained in a fuel rail upstream of the injectors which is held under pressure.

The above described strategy is dependent on the fuel in the fuel rail and in the injectors being in the liquid state. A further problem is that the fuel in the fuel rail can evaporate at higher fuel rail and injector temperatures, resulting in fuel vapours, or a mixture of fuel vapours and liquid fuel, being delivered when the fuel injectors open during an engine crank. This may occur, for instance, if an engine is re-started while still warm. The tendency for the fuel to evaporate will increase with increasing fuel rail temperature, decreasing fuel rail pressure and increasing fuel volatility. Residence time of the fuel in the fuel rail, that is, the time that has passed since the engine was last operated, may also affect the fuel evaporation. However, once the engine has been started the pressure in the fuel line will increase and the temperature will be lowered by the relatively cold fuel pumped from the fuel tank. After a period of time, liquid fuel will again be available for supply to the liquid fuel injectors.

Starting and operating the engine with evaporated fuel in the fuel rail may result in a too lean Air/Fuel ratio during and after start, causing rough engine running, misfire and poor engine performance. In severe cases it can lead to the engine failing to start.

The tendency for the fuel to evaporate in the fuel rail is a function of the fuel rail pressure, fuel volatility and fuel rail temperature. If the fuel rail pressure is increased during engine off periods this tendency of fuel evaporation is decreased, However, a further problem is that by increasing the fuel rail pressure before the engine is switched off, the evaporate emissions from the fuel system may increase due to increased leakage from the fuel through the injectors and other fuel system couplings and connections.

The present invention is therefore directed to solve the above problems by providing an improved injection control system for supplying fuel to an internal combustion engine during start-up.

SUMMARY OF THE INVENTION

The invention relates to an injection control system for supplying fuel vapour to an internal combustion engine during start-up and to a method for using the injection control system.

The problem of poor engine start and after start performance when injecting fuel that has evaporated in the fuel rail, as described in the problem description, cannot be solved by increasing the injector opening time since the state of the fuel cannot be directly identified. Consequently, the required quantity of fuel can not be accurately delivered to the engine.

To solve this problem the purge vapours from a purge vapour control system in the vehicle can be used to assist the engine start and after start by opening and controlling the purge valve and thus allowing fuel vapours into the intake manifold and the engine. As the mass flow rate of the vapours from a canister in said purge vapour control system supplied to the intake manifold through the purge valve is higher than the mass flow rate of the vapours that can be supplied to the intake manifold through the injectors from the evaporated fuel in the fuel rail, engine start and after start performance is enhanced provided the correct quantity of purge vapours are delivered to the intake manifold and thus to the engine. The purge valve delivers fuel from the canister, which fuel is always in the vapour state and is therefore easier to control the fuel vapour delivery to the engine under conditions that result in the fuel stored in the fuel rail being evaporated. If purge vapours are available in sufficient quantity, the purge vapours from the canister may also be used as the sole source of fuel.

According to the invention, an injection control system is provided for supplying fuel vapour to an internal combustion engine during start-up and subsequent operation of the engine. The injection control system comprises a fuel tank, a fuel tank vapour line coupled to said fuel tank, a purge vapour collection canister coupled to said fuel tank vapour line, a purge vapour line coupled to said purge vapour collection canister and at least one fuel vapour injector disposed in an air intake manifold and coupled to said purge vapour line via a controllable valve. The system further comprises a liquid fuel injection delivery device and a liquid fuel line coupled to the said liquid fuel injection delivery device and to said at least one liquid fuel injector.

The fuel injector may comprise a combined injector, containing a liquid fuel injection delivery device mounted adjacent a fuel vapour injector. Alternatively, separately mounted injectors for vapour and fuel may be used.

For instance, a combined injector may be placed in the air intake conduit or manifold. Alternatively, a liquid fuel injector can be mounted for direct injection into the combustion chamber, while a vapour injector can be placed in the air intake conduit or manifold.

According to one embodiment, the injection control system comprises sensors for measuring variables indicating the state of the fuel in the liquid fuel line and an electronic control unit for determining the state of the fuel in the liquid fuel line based on the output of said sensors. The electronic control unit may be arranged to control the controllable valve for permitting delivery of fuel vapour to the air intake manifold depending on the current state (liquid or vapour) of the fuel in the liquid fuel line. When the state of the fuel has been determined the electronic control unit may decide to use the canister purge vapours to assist engine start. The liquid fuel line may preferably, but not necessarily, be a pressurized fuel line, such as a fuel rail, supplied by a high pressure fuel pump connected to the fuel tank.

According to an alternative embodiment, the state of the fuel in the fuel line can be estimated by the electronic control unit using the fuel line temperature and pressure. Values of temperature and pressure can be obtained using transducers or other suitable sensors. According to an alternative embodiment the residence time of the fuel in the rail may be used in addition to the above measurements. A suitable time signal for this purpose can be obtained from the electronic control unit, which may be programmed to count the time expired since the previous engine off event. The electronic control unit may be arranged to control the said controllable valve in the purge vapour line for permitting delivery of fuel vapour from the purge vapour collection canister to the air intake manifold if it is determined that fuel vapour is present in the liquid fuel line. Hence, when the engine is cranked for start-up while vapour is determined in the liquid fuel line, fuel may be supplied in the form of vapour from the liquid fuel injectors and/or the purge vapour collection canister.

Allowing the canister purge vapours to assist engine start and after start can reduce or eliminate the need to increase fuel line pressure during engine off periods to avoid or minimize fuel evaporation. This is an advantage, since an increased pressure in the fuel line may lead to evaporative emissions due to possible fuel leaks, as described above.

The electronic control unit may be arranged to monitor the state of the fuel in the liquid fuel line or fuel rail continuously. When it is determined that the fuel in the liquid fuel line or fuel rail is in a liquid state, delivery of fuel from the at least one liquid fuel injector is permitted. Subsequently, selectively delivery of fuel from the liquid fuel line or the purge vapour collection canister is permitted. Once it has been determined that the state (liquid or vapour) of the fuel in the fuel rail is liquid, the electronic control unit may decide when to shut down the canister purge vapour flow and resume normal operation.

According to a further alternative embodiment, the electronic control unit may be arranged to estimate the loading state of the purge vapour collection canister and to calculate a required flow rate through the controllable valve for delivery of a desired amount of fuel vapour.

The initial flow of canister purge vapours required in engine assist can be estimated by using the calculated or measured loading state, that is, the concentration of hydrocarbon vapours, of the canister, as well as a number of other parameters, such as fuel rail temperature and pressure.

The loading state may be estimated using the lambda sensor. First the engine is operated at a steady state using a stoichiometric air/fuel mixture, where X=1, with the canister purge function switched off. The purge function will then be switched on, whereby the purge valve is opened to purge vapours from the canister to the engine. The exhaust oxygen sensor will register an increasingly rich fuel mixture due to the added fuel vapour and the changing lambda value over time is used to estimate the loading state of the canister, which loading state is stored in the electronic control unit,. When the engine is switched on, the last previously calculated value for the loading state is immediately available. If the vehicle has been stationary for a relatively long period of time, the stored value may need to be adjusted for additional fuel vapour absorbed from the tank during this period. The stored value may also need to be adjusted following a soak period where engine temperature and ambient temperature are high at engine off. Such a period is often termed "hot soak". The temperature in the liquid fuel rail will as a rule peak within an hour of the engine being switched off. Such adjustment may be carried out based on available values for ambient temperature and/or coolant or oil temperature.

According to a further alternative embodiment, the electronic control unit may be arranged to monitor at least one combustion related parameter and to control the controllable valve to maintain a desired combustion quality. The initial canister purge vapour flow to the engine can be adjusted as a function of the desired engine combustion quality, using combustion related parameters such as combustion stability, misfire, early or late ignition, lean or rich mixture and knocking occurring during engine crank and engine start.

The electronic control unit may be arranged to monitor the engine miscombustion, for instance by monitoring the crankshaft acceleration, at least during engine crank and engine start. The initial canister purge vapour flow to the engine may be adjusted as a function of a measured or estimated acceleration signal. The engine acceleration signal may be obtained from one or more existing sensors, such as a transducer mounted on or adjacent to the crankshaft.

After engine start, the canister purge vapour flow to the engine may also be controlled as a function of a deviation between measured engine speed and a target speed. This is an open loop fuel control that may be used prior to an exhaust oxygen sensor, also termed lambda sensor, being enabled.

Once the exhaust oxygen sensor is active, the electronic control unit is arranged to monitor the exhaust oxygen sensor after engine start. The canister purge vapour flow to the engine may then be controlled as a function of the exhaust oxygen sensor signal. This closed loop fuel control may be used at any time as soon as the exhaust oxygen sensor has been enabled.

The invention also relates to a method for supplying fuel to an internal combustion engine. A number of strategies for controlling the supply of purge vapours into the engine depending on the state of the fuel in the liquid fuel supply line may be used. For instance, a first strategy may be used for crank and start-up and a second strategy may be used after start.

According to a preferred embodiment, the method includes: determining the state of a fuel in a liquid fuel line; selecting at least one source of fuel depending on the state of the fuel in the liquid fuel line; calculating a target mass flow rate for each selected source of fuel to be supplied from the at least one selected source of fuel to the engine after a start-up event; and delivering the calculated target mass flow rate of fuel from each source of fuel to a fuel injector for the respective fuel.

The fuel is then injected into the intake manifold and is subsequently combusted in the internal combustion engine.

As described above, the calculation of the target mass flow rate for each selected source of fuel to be supplied depending on the state of the fuel in the liquid fuel line. Once it has been determining that a start-up event has occurred, a timer, or a similar function provided in the electronic control unit, may be started to count the time since the latest start-up event. Such a function may also be used for measuring elapsed time after the engine has been switched off.

According to an alternative embodiment, the strategy used for crank and start-up may involve selecting purge vapour fuel as the sole source of fuel. Once it has been determined vapour is present in the liquid fuel line, the electronic control unit calculates a target purge vapour mass flow rate to be supplied from a purge vapour control system to the engine after the start-up event, if vapour is detected in the liquid fuel line. Subsequently the controllable valve in the purge vapour line is opened by a determined amount to deliver said target purge vapour mass flow rate of fuel vapours from a purge vapour control system to a fuel injector. The purge vapour fuel is then injected into the internal combustion engine.

During engine cranking or start-up, an actual purge vapour mass flow rate of said fuel vapours may be determined. The electronic control unit may then adjust the controllable valve depending on the difference between the target purge vapour mass flow rate and a calculated purge vapour mass flow rate.

The strategy used for crank and start-up may also involve selecting purge vapour fuel and vapour from liquid fuel rail as a combined source of fuel. Hence, when the engine is cranked for start-up while vapour is determined in the liquid fuel line, fuel may be supplied in the form of vapour from the liquid fuel injectors and/or the purge vapour collection canister. This will drain vapour from liquid fuel rail and speed up the cooling of the fuel rail, relatively cool liquid fuel from the fuel tank will replace the evaporated fuel.

During engine cranking or start-up, an actual vapour mass flow rate of said fuel vapours may be determined. The electronic control unit determines an amount of evaporated fuel from the liquid fuel line to replace with purge vapour fuel. It then calculates a target purge vapour mass flow rate required to replace said amount of evaporated fuel with purge vapour fuel. Subsequently, a quantity of evaporated fuel is delivered from the liquid fuel injection system to said liquid fuel injector corresponding to said actual purge vapour mass flow rate of said purge vapour fuel such that a desired total amount of fuel is delivered to the respective fuel injectors.

According to an alternative embodiment, the strategy used for crank and start-up may involve selecting both liquid fuel and purge vapour fuel. Once it has been determined liquid is present in the liquid fuel line, the electronic control unit determines an amount of liquid fuel to replace with purge vapour fuel after a start-up event. It then calculates a target purge vapour mass flow rate required to replace said amount of liquid fuel with purge vapour fuel. Subsequently, a quantity of liquid fuel is delivered from a fuel injection system to said liquid fuel injector corresponding to said actual purge vapour mass flow rate of said fuel vapours such that a desired total amount of fuel is delivered to the respective fuel injectors.

The electronic control unit may be arranged to monitor the state of the fuel in the liquid fuel line continuously after start-up of the engine, and may be arranged to reduce the amount of vapour fuel to zero when liquid fuel is detected in said liquid fuel line.

The purge valve can be opened during crank as a function of fuel rail temperature and pressure, either measured directly or modelled, canister state, by means of purge adaptation value or similar, and fuel volatility, by means of cold start fuel adaptation and warm fuel adaptations. Additionally, the purge valve position can be adjusted after each combustion, depending on the quality of the combustion.

After start the purge valve can be opened in function of fuel rail temperature and pressure, canister state and fuel volatility, as described above.

Additionally, the purge valve position can be adjusted depending on the deviation of the engine speed and target engine speed at idle conditions. If the engine speed is below the target engine speed at idle more purge vapours can be delivered to the intake manifold to have a richer air fuel ratio and thus increase engine torque to assist after start performance.

According to an alternative embodiment, the electronic control unit estimates the loading state of the purge vapour collection canister. The target purge vapour mass flow rate may then be calculated based the loading state of the purge vapour collection canister. The electronic control unit may then adjust the controllable valve for delivery of the target purge vapour mass flow rate of fuel vapour. In this way the concentration of hydrocarbons in the purge vapour can be compensated for, in order to supply fuel with a desired Air/Fuel ratio to the engine.

According to a further alternative embodiment, the method involves controlling the supply of fuel vapour and/or liquid fuel to maintain a desired combustion quality. This is achieved by monitoring a combustion related parameter indicating a desired engine combustion quality and adjusting the canister purge vapour flow to the engine as a function of the engine combustion quality during engine crank and engine start. Examples of such combustion related parameters have been listed above.

According to one example, the electronic control unit monitors engine miscombustion may preferably, but not necessarily, be determined by means of an acceleration sensor during engine crank and engine start. The canister purge vapour flow to the engine may then be adjusted as a function of variations in engine acceleration.

According to a further example, the electronic control unit monitors an engine speed sensor and adjusts the canister purge vapour flow to the engine as a function of the engine speed deviation from a target speed.

According to a further example, the electronic control unit monitors an exhaust oxygen sensor after engine start. Once the exhaust oxygen sensor is enabled, the canister purge vapour flow to the engine may be adjusted as a function of the exhaust oxygen sensor signal For the methods in all the above embodiments, the state of the fuel in the liquid fuel line may be determined by estimating pressure and temperature in the liquid fuel line. Additional parameters that can be used for determining the state of the fuel in the fuel line are elapsed time since engine off, engine coolant temperature at ignition off and/or the residence time of the fuel in the fuel line. The residence time has been defined in the text above. The state of the fuel in the fuel line may be determined once, at start-up, or monitored intermittently or constantly after crank.

Although the above text mainly refers to engine start-up, the method can also be applied to subsequent operation of the engine if fuel evaporation should occur in the liquid fuel line.

Finally, the invention also relates to a vehicle provided with an injection control system as described above.

BRIEF DESCRIPTION OF DRAWINGS

In the following text, the invention will be described in detail with reference to the attached drawings. These schematic drawings are used for illustration only and do not in any way limit the scope of the invention. In the drawings.

DESCRIPTION OF PREFERRED EMBODIMENT(S)

Figure 1:
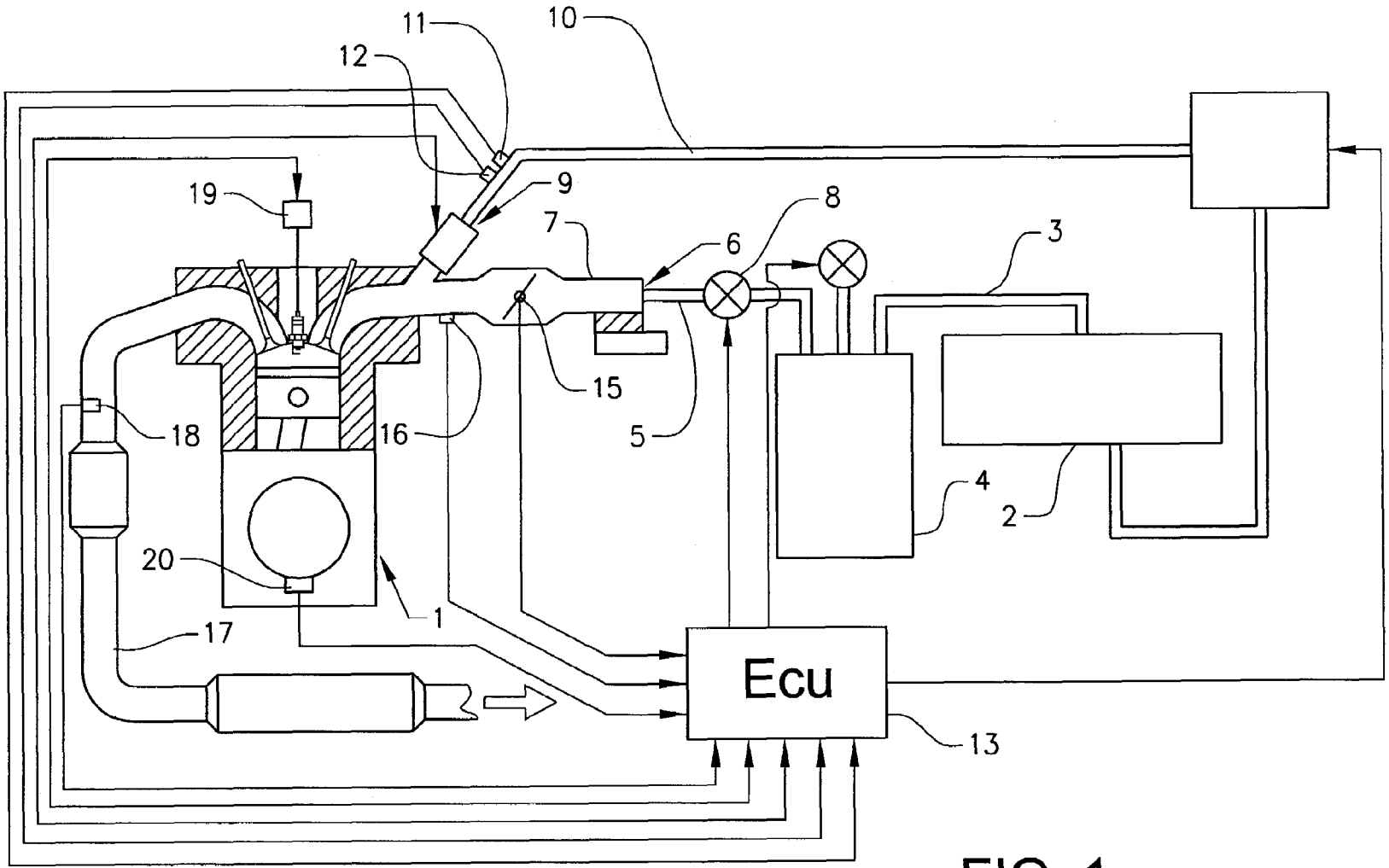
FIG. 1 shows a schematic illustration of a purge vapour control system according to the present invention.

FIG. 1 shows one embodiment of an injection control system. The system is arranged to supply fuel vapour to an internal combustion engine I during start-up and subsequent operation of the engine. The injection control system comprises a fuel tank 2, a fuel tank vapour line 3 coupled to said fuel tank 2, a purge vapour collection canister 4 coupled to said fuel tank vapour line 3, a purge vapour line 5 coupled between said purge vapour collection canister 4 and at least one fuel vapour injector 6 disposed in an air intake manifold 7 and coupled to said purge vapour line 5 via a controllable valve 8. The system further comprises a liquid fuel injection delivery device 9 and a liquid fuel line 10 coupled to the said liquid fuel injection delivery device and to said at least one liquid fuel injector.

In the embodiment illustrated in FIG. 1, separately mounted injectors for vapour and liquid fuel are used. Alternatively, the fuel injector may comprise a combined injector, containing a fuel vapour injector mounted adjacent or combined with the liquid fuel injection delivery device 9 in the air intake conduit or manifold.

The injection control system comprises pressure and temperature sensors 11, 12 to provide output signals indicating the state of the fuel in the liquid fuel line 10 and an electronic control unit (ECU) 13 for determining the state of the fuel in the liquid fuel line 10 based on the output of said sensors 11, 12. The electronic control 13 unit is arranged to control the controllable valve 8 for permitting delivery of fuel vapour to the air intake manifold depending on the current state, that is liquid or vapour, of the fuel in the liquid fuel line 10. The ECU 13 also controls a second controllable valve 14 connected to the canister 4. This second controllable valve 14 is normally open and connects the canister to the atmosphere during periods of purging of the canister. When a loading state of the canister 4 requires the canister to be purged, ambient air is drawn through the canister and controllable valve into the intake manifold. When the state of the fuel in the liquid fuel line 10 has been determined the electronic control unit decides whether to use the canister purge vapours to assist engine start.

The ECU 13 receives further input from sensors relating to the control and operating status of the engine, such as a throttle position sensor 15 and a mass flow rate sensor 16 in the air intake manifold 7. Combusted exhaust gas passes through an exhaust gas conduit 17 provided with an exhaust oxygen sensor 18, which, when enabled, returns a feedback signal to the ECU 13 allowing it to calculate a fuelling signal that is transmitted to the fuel injector 9. In addition, the ECU 13 is connected to an ignition module 19 in order to control ignition timing as well as intake and exhaust valve timing, if available, and to an engine speed sensor for indicating the speed of the crankshaft.

Figure 2:
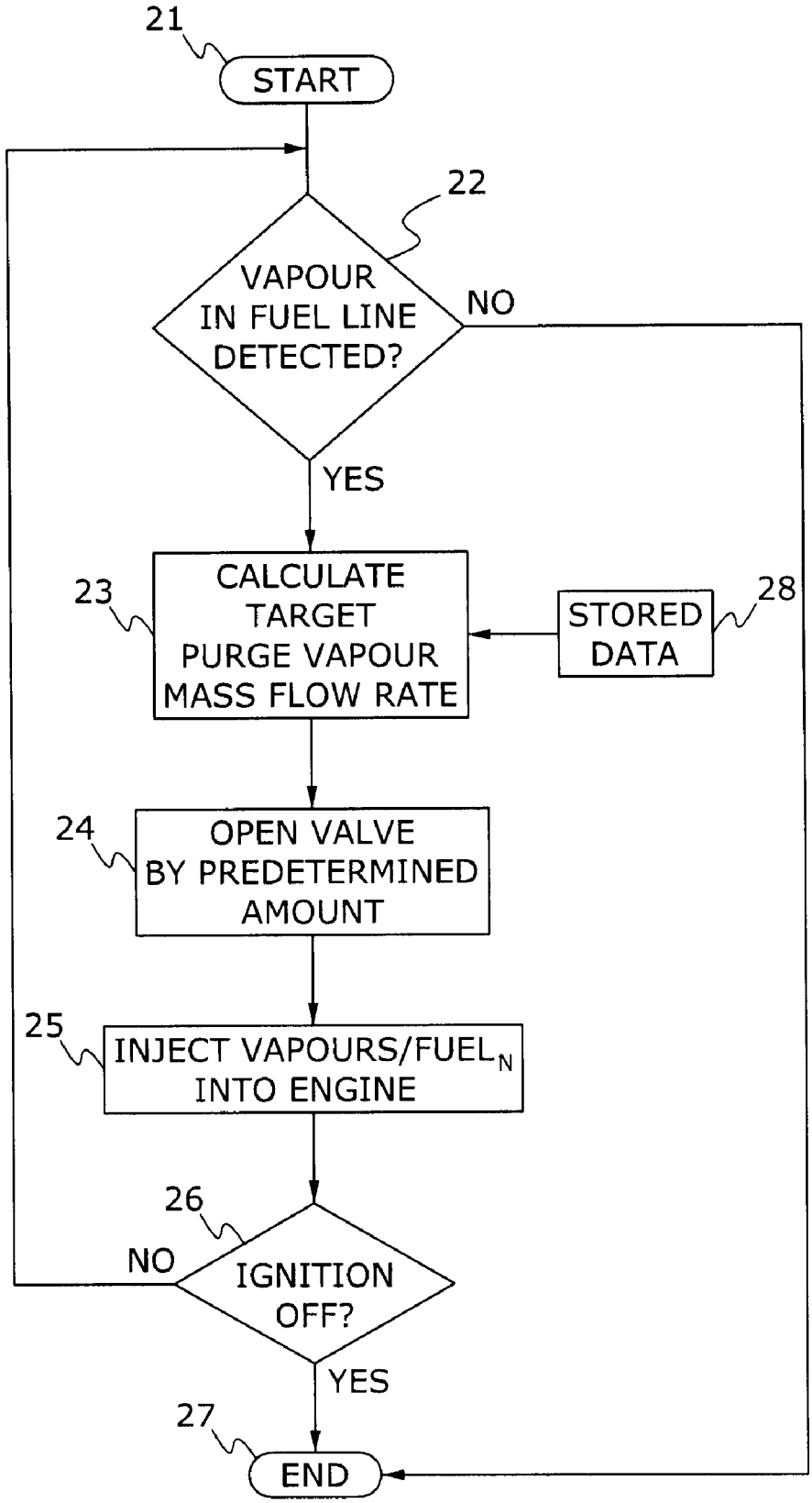
FIG. 2 shows a flow chart depicting a control method for the purge vapour control system of FIG. 1.

FIG. 2 shows a flow chart indicating a sequence of steps used by the control method for the purge vapour control system of FIG. 1. In operation, the control method is initiated at block 21, when the ECU detects that the engine is being cranked using the engine speed sensor 20. In a first step, indicated by block 22, the ECU will use input signals from the pressure and temperature sensors 11, 12 to determine if the fuel in the liquid fuel line 10 is in a vapour or liquid state. If vapour is detected in the liquid fuel line, block 23 will select a first operation strategy. The ECU will calculate a target purge vapour mass flow rate to be supplied from the purge vapour control system to the engine. This first strategy is primarily used for start crank and start-up, at a time when purge vapour fuel will be selected as one source of fuel. In block 24, the ECU transmits a signal to open the controllable valve 8 in the purge vapour line 5 by a predetermined amount to deliver said target purge vapour mass flow rate of fuel vapours from the purge vapour canister 4 to the vapour fuel injector 6. In block 25, the fuel vapours are injected into said internal combustion engine where said fuel vapours are combusted.

The ECU 13 will then check whether the ignition is OFF in block 26. If the 30 ignition is OFF, then the sequence is ended in block 27. If the ignition is ON, then the sequence is returned to block 22 to determine if the fuel in the liquid fuel line 10 is in a vapour or liquid state. If vapour is still present in the liquid fuel line, block 23 is selected to re-calculate a new target purge vapour mass flow rate. When making this calculation, the ECU uses a stored value for the canister loading, that is, the concentration of fuel vapour in the canister 4, and compares the actual engine speed with a target speed, such as the idling speed. For instance, if the engine speed is below the target engine speed at idle, more purge vapours can be delivered to the intake manifold to have a richer air fuel ratio and thus increase engine torque to assist after start performance. Required data, both measured and stored, are taken from data block 28.

In addition to a calculated or measured canister loading the ECU may use fuel volatility, a measured mass flow rate and/or the pressure difference between canister and intake manifold to determine the required degree of opening of the controllable valve 8. Instead of using the actual engine speed for the above calculations, it is also possible to use a measured or calculated engine acceleration to estimate the quality of the combustion and to control the controllable valve 8 accordingly. The above data can also be stored in data block 28.

The above loop continues to use the first strategy until it is detected that the ignition is switched off or that it is determined that the fuel in the liquid fuel line 10 is in a liquid state. When liquid fuel is detected in the liquid fuel line, block 23 will select a second operation strategy. If required by the strategy, the ECU will calculate a percentage of liquid fuel to be replaced by purge vapour. Measured and stored data required for this calculation is taken from data block 28. In block 23 the ECU will also calculate a target purge vapour mass flow rate to be supplied from the purge vapour control system. In block 24, the ECU transmits a signal to open the controllable valve 8 in the purge vapour line 5 by a pre-selected amount to deliver said target purge vapour mass flow rate of fuel vapours from the purge vapour canister 4 to the vapour fuel injector 6. In block 25, the calculated amount of fuel vapours and remaining liquid fuel is injected into said internal combustion engine where said fuel vapours and injected and vaporized liquid fuel are combusted.

The ECU will then check whether the ignition is OFF in block 26. If the 5 ignition is OFF, then the sequence is ended in block 27. If the ignition is ON, then the sequence is returned to block 22 to determine if the fuel in the liquid fuel line 10 is in a vapour or liquid state. If liquid is still present in the liquid fuel line, block 23 is selected to re-calculate a new percentage of liquid fuel to be replaced by purge vapour. If purge vapour is still required, then a new target purge vapour mass flow rate is calculated.

When the engine has warmed up, the ECU will, unless vapour is detected in the liquid fuel line or if the engine control strategy dictates otherwise, supply all fuel from the liquid fuel injector. The second strategy contains instructions controlling if and when the supply of purge vapour is stopped.

The invention is not limited to the above embodiments, but may be varied freely within the scope of the claims.

The invention claimed is:

1. An injection control system for supplying fuel vapour to an internal combustion engine, comprising:

a fuel tank;

a fuel tank vapour line coupled to said fuel tank;

a purge vapour collection canister coupled to said fuel tank vapour line;

a purge vapour line coupled to said purge vapour collection canister;

at least one fuel injector disposed in an air intake manifold and coupled to said purge vapour line via a controllable valve;

a liquid fuel injection delivery device;

a liquid fuel line coupled to said liquid fuel injection delivery device and to said at least one fuel injector; and an electronic control unit for determining the state of the fuel in the liquid fuel line based on the output of said sensors, where said electronic control unit is arranged to control the controllable valve for permitting delivery of fuel vapour from the purge vapour collection canister to the air intake manifold dependent on the current state of the fuel in the liquid fuel line.

2. The injection control system according to claim 1, wherein said electronic control unit is arranged to control the said controllable valve for permitting delivery of fuel vapour if it is determined that fuel vapour is present in the liquid fuel line.

3. The injection control system according to claim 1, wherein said electronic control unit is arranged to estimate the loading state of the purge vapour collection canister and to calculate a required flow rate through the controllable valve for delivery of a desired amount of fuel vapour.

4. The injection control system according to claim 1, wherein said electronic control unit is arranged to monitor a combustion related parameter and to control the controllable valve as a function of this parameter to maintain a desired combustion quality.

5. The injection control system according to claim 4, wherein said electronic control unit is arranged to monitor an engine acceleration sensor during engine crank and engine start.

6. The injection control system according to claim 4, wherein electronic control unit is arranged to monitor an engine speed sensor and to determine a speed deviation between actual engine speed and a target speed.

7. The injection control system according to claim 4, wherein said electronic control unit is arranged to monitor an exhaust oxygen sensor after engine start.

8. The injection control system according to claim 1, wherein said electronic control unit is arranged to determine the state of the fuel in the liquid fuel line during start-up of the engine.

9. The injection control system according to claim 1, wherein said electronic control unit is arranged to monitor the state of the fuel in the liquid fuel line after start-up of the engine, and arranged to reduce the amount of vapour fuel to zero when liquid fuel is detected in said liquid fuel line.

10. The injection control system according to claim 1, wherein said electronic control unit is arranged to use the output from pressure and temperature sensors in the liquid fuel line to determine the state of the fuel in the liquid fuel line.

11. The injection control system according to claim 1, wherein the liquid fuel line is a pressurized fuel rail.

12. A method for supplying fuel to an internal combustion engine, comprising:

determining the state of a fuel in a liquid fuel line;

selecting at least one source of fuel depending on the state of the fuel in the liquid fuel line;

calculating a target mass flow rate for each selected source of fuel to be supplied from the at least one selected source of fuel to the engine after a start-up event;

delivering the calculated target mass flow rate of fuel from each source of fuel to a fuel injector for the respective fuel; and injecting said fuel into said internal combustion engine.

13. The method according to claim 12, wherein the state of the fuel in a liquid fuel line has been determined, comprising:

calculating a target purge vapour mass flow rate to be supplied from a purge vapour control system to the engine after the start-up event, if vapour is detected in the liquid fuel line;

opening a controllable valve in a purge vapour line by a pre-selected amount to deliver said target purge vapour mass flow rate of fuel vapours from a purge vapour control system to a vapour fuel injector.

14. The method according to claim 13, further comprising:

determining an actual purge vapour mass flow rate of said fuel vapours;

adjusting the controllable valve depending on the difference between the target purge vapour mass flow rate and the actual purge vapour mass flow rate.

15. The method according to claim 13, further comprising:

determining an amount of liquid fuel to replace with purge vapour fuel, if liquid fuel is detected in the liquid fuel line;

calculating a target purge vapour mass flow rate required to replace said amount of liquid fuel with purge vapour fuel; and delivering a quantity of liquid fuel from a fuel injection system to said fuel injector corresponding to said actual purge vapour mass flow rate of said fuel vapours such that a desired total amount of fuel is delivered to said fuel injector.

16. The method according to claim 15, further comprising:

monitoring the state of the fuel in the liquid fuel line after start-up of the engine, and reducing the amount of vapour fuel to zero when liquid fuel is detected in said liquid fuel line.

17. The method according to claim 15, further comprising:

estimating the loading state of the purge vapour collection canister;

calculating the target purge vapour mass flow rate based the loading state of the purge vapour collection canister; and adjusting the controllable valve for delivery of the target purge vapour mass flow rate of fuel vapour.

18. The method according to claim 15, further comprising:

monitoring a combustion related parameter indicating a desired engine combustion quality; and adjusting the canister purge vapour flow to the engine as a function of the engine combustion quality during engine crank and engine start.

19. The method according to claim 18, further comprising:

monitoring an engine acceleration sensor during engine crank and engine start; and adjusting the canister purge vapour flow to the engine as a function of variations in engine acceleration.

20. The method according to claim 18, further comprising:

monitoring an engine speed sensor; and adjusting the canister purge vapour flow to the engine as a function of the engine speed deviation from a target speed.

21. The method according to claim 18, further comprising:

monitoring an exhaust oxygen sensor after engine start; and adjusting the canister purge vapour flow to the engine as a function of the exhaust oxygen sensor signal.

22. The method according to claim 21, further comprising:

estimating pressure and temperature in the liquid fuel line to determine the state of the fuel in the liquid fuel line.

23. The method according to claim 22, further comprising:

estimating a residence time of the fuel in the fuel line to determine the state of the fuel in the liquid fuel line.

* * * * *